US010857556B2

(12) United States Patent
Wang

(10) Patent No.: US 10,857,556 B2
(45) Date of Patent: Dec. 8, 2020

(54) SPRINKLER HEAD OF VISUAL IDENTIFICATION

(71) Applicant: ARIA PRODUCTS L.L.C., Dover, DE (US)

(72) Inventor: Daniel Chun Wang, Chung Hua Hsien (TW)

(73) Assignee: ARIA PRODUCTS L.L.C., Dover, DE (US)

( * ) Notice: Subject to any disclaimer, the term of this patent is extended or adjusted under 35 U.S.C. 154(b) by 196 days.

(21) Appl. No.: 15/647,499

(22) Filed: Jul. 12, 2017

(65) Prior Publication Data

US 2017/0304857 A1 Oct. 26, 2017

Related U.S. Application Data

(62) Division of application No. 15/083,854, filed on Mar. 29, 2016.

(51) Int. Cl.
*B05B 12/00* (2018.01)
*B05B 15/74* (2018.01)

(52) U.S. Cl.
CPC ..... *B05B 12/004* (2013.01); *B05B 12/00* (2013.01); *B05B 15/74* (2018.02)

(58) Field of Classification Search
CPC ..... B05B 12/004; B05B 15/10; B05B 1/26; B05B 1/267; B05B 1/3073; B05B 3/021
USPC ..... 239/11, 457, 460, 498, 513, 539
See application file for complete search history.

(56) References Cited

U.S. PATENT DOCUMENTS 1,984,839 A 12/1934 Murray
2011/0248097 A1* 10/2011 Kim ..... B05B 1/267 239/222.11
2013/0334340 A1* 12/2013 Walker ..... B05B 3/0477 239/222.15

* cited by examiner

*Primary Examiner* — Qingzhang Zhou
(74) *Attorney, Agent, or Firm* — Muncy, Geissler, Olds & Lowe, P.C.

(57) ABSTRACT

A sprinkler head of visual identification is disclosed. A housing includes a circumference wall, a cap enclosing the circumference wall, and an aperture member alternatively formed on the cap and the circumference wall for dispensing water. A first visual portion is arranged on the circumference wall of the housing and corresponds with the aperture member. A second visual portion, which is visually different from the first visual portion, is arranged on the circumference wall and adjoins the first visual portion. The first and second visual portions constitute the circumference wall of the housing together, a visual differentiation of the first recognition portion and the second one is offered in accordance with the arrangement of dissimilar art elements.

12 Claims, 16 Drawing Sheets

SPRINKLER HEAD OF VISUAL IDENTIFICATION

CROSS-REFERENCE TO RELATED APPLICATION

This application is a divisional of application Ser. No. 15/083,854, filed on Mar. 29, 2016.

BACKGROUND

1. Technical Field

The present invention relates to a sprinkler head, specifically to a sprinkler head of visual identification.

2. Background of the Invention

For tools, identification marking is a well-known art dating as early as 1932 as disclosed by U.S. Pat. No. 1,984,839 entitled "Identification Means for Tools". For irrigation sprinklers, however, nozzle identification is often a neglected field.

In-ground pop-up sprinklers such as Rain Bird SP40-Q typically includes means for identifying nozzle angle and direction. Referring to FIG. 16, such means may include one or both of a fan-shaped mark 80 and a patterned recognition arc 90 for pointing out the spray pattern. For low-flow irrigation, sometimes known as micro-irrigation, the sprinkler heads are substantially smaller than the counterparts in in-ground irrigation, thus space for marking is very limited. Therefore, an identification method applicable to in-ground irrigation is often not appropriate to low-flow irrigation. Some low-flow sprinkler manufacturers use monochromatic colors to differentiate visually similar sprinklers with different spray patterns and provide training on the color scheme.

In the interest of facilitating maintenance of low-flow irrigation system by providing easy identification of spray patterns, a sprinkler head capable of visual identification is desired.

SUMMARY

It is therefore one or more aspects to provide a sprinkler head of visual identification, so as to offer means of simple identification to enable quick field installation and maintenance.

It is therefore one or more aspects to provide a sprinkler head of visual identification that is not arbitrary and requires little or no user training.

It is therefore one or more aspects to provide a sprinkler head of visual identification provided with first and the second boundary members of predetermined but distinct art elements for observation.

To achieve objects of the present invention, a sprinkler head of visual identification is disclosed. The sprinkler head includes a housing having a circumference wall, and at least one first recognition portion and at least one second recognition portion disposed on the circumference wall and adjoins with one another in a head-to-tail manner. The housing defines an axis, around which the circumference wall surrounds, a cap enclosing the circumference wall, and at least one aperture member alternatively formed on the cap and the circumference wall for dispensing water. The aperture defines a periphery. The first recognition portion corresponds with and spans over the periphery of the aperture member. The second recognition portion is visually different from the first recognition portion.

Other advantages and features of the present invention will be fully understood by reference to the following specification in conjunction with the accompanying drawings, in which like reference signs denote like components of structure.

DETAILED DESCRIPTION OF THE INVENTION

Figure 1:
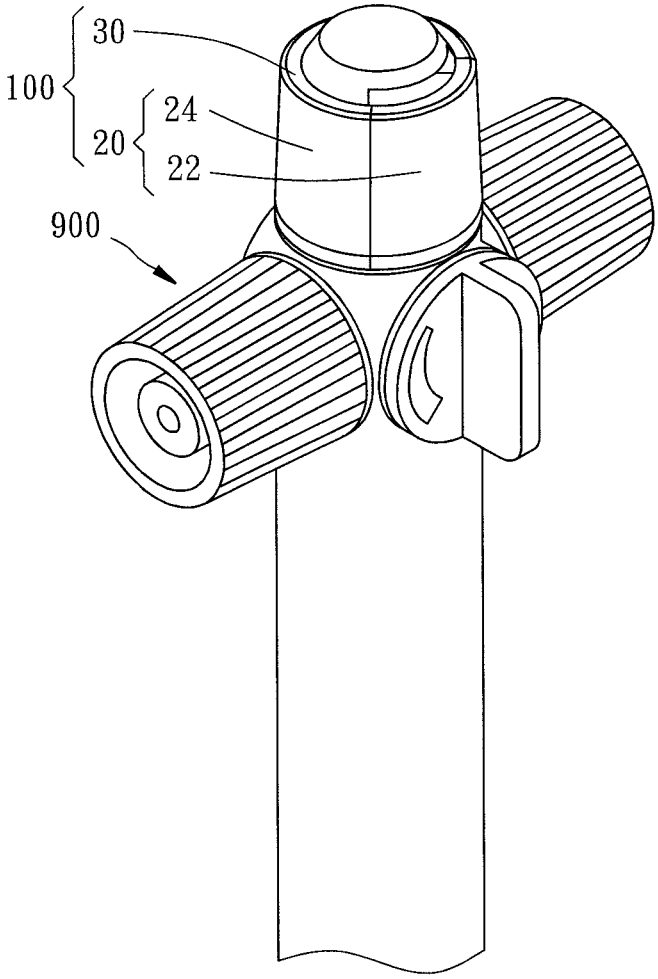
FIG. 1 is a perspective view showing a sprinkler head of visual identification adapted for an outlet body in accordance to a first embodiment of the present invention.

The present invention relates to a sprinkler head 100 of visual identification adapted for a sprinkler device 900, illustrated in FIG. 1. The sprinkler head 100 is generally hollow, and includes a housing 10, and at least one first recognition portion 22 and at least one second recognition portion 24 arranged on housing 10. The sprinkler head 100 of visual identification according to the embodiments of the present invention will be described with reference to the drawings. Repeated description thereof may be omitted.

First Embodiment

Figure 2:
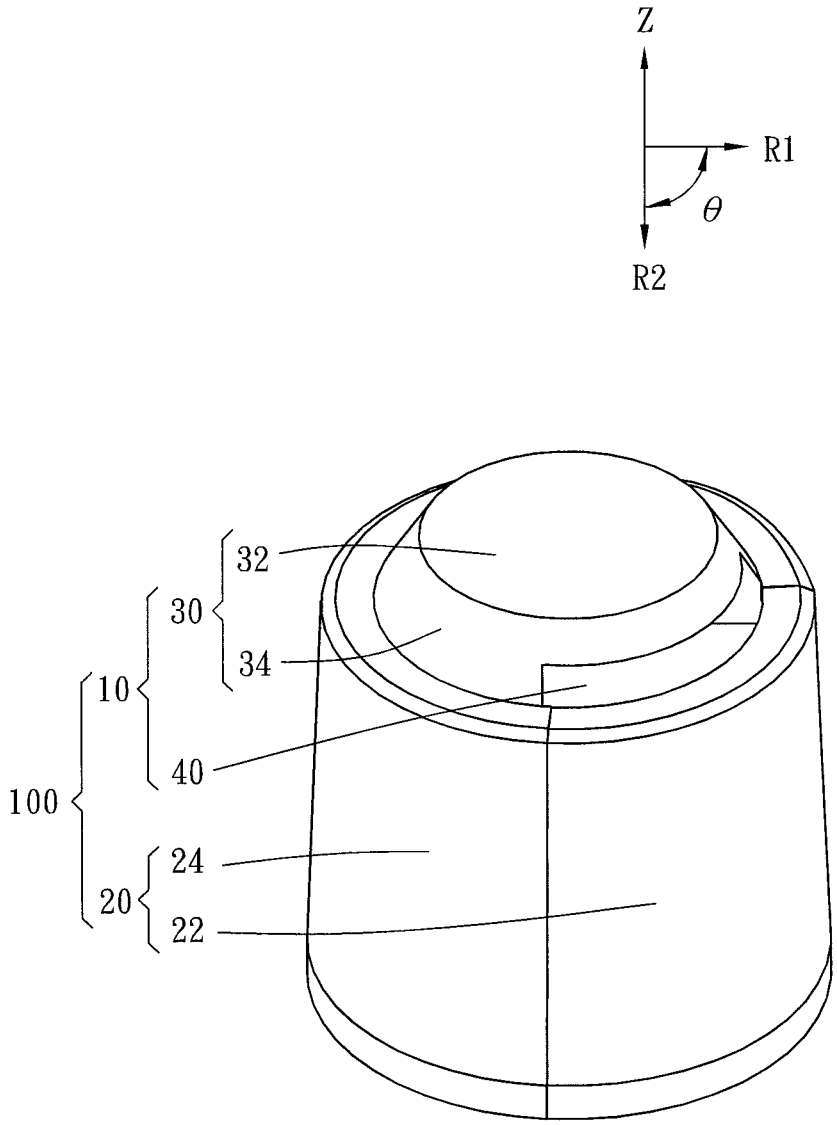
FIG. 2 is a perspective view illustrating the sprinkler head of visual identification in accordance to FIG. 1.
Figure 3:
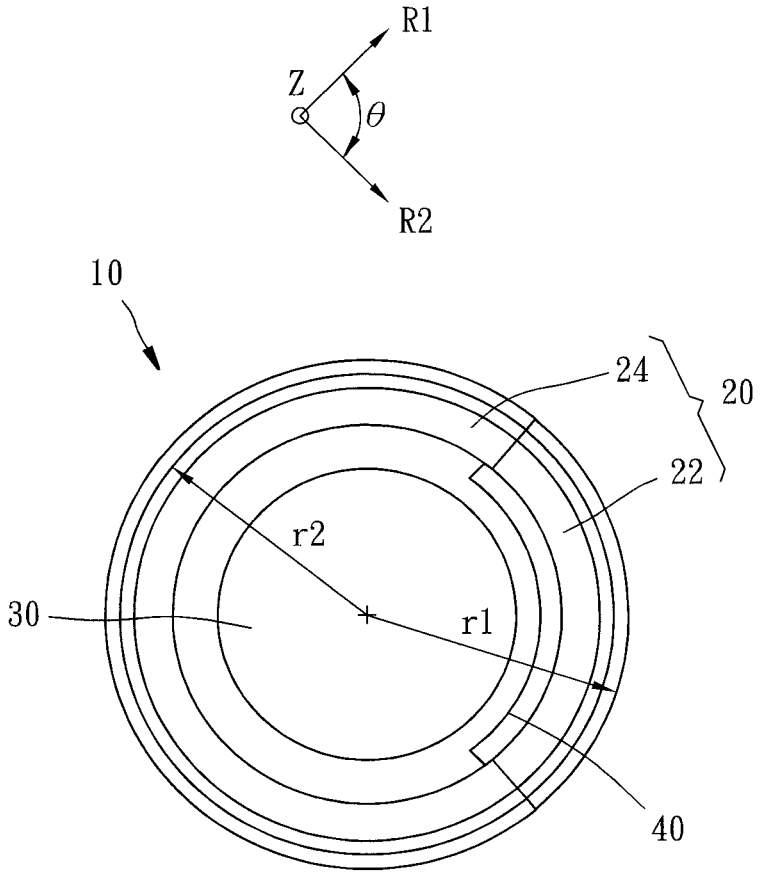
FIG. 3 is a top view in accordance to FIG. 2.

FIGS. 1 through 3 pertain to a first embodiment of the invention. In a cylindrical coordinate system, the housing 10 defines an axis Z, which is an imaginary axis, and a positive angle θ, which is measured from a first reference axis R1 to a second reference axis R2 in a clockwise manner on a plane perpendicular to the axis Z. The housing 10 includes a circumference wall 20 surrounding around the axis Z, a cap 30 enclosing a top of the circumference wall 20, and at least one aperture member 40 alternatively formed on the cap 30 and the circumference wall 20 for dispensing water.

The first and second recognition portions 22, 24 dispose on the circumference wall and adjoin with one another in a head-to-tail manner;

The cap 30 includes a top 32, and a circumference partition 34 connecting the top and the circumference wall 20.

The aperture member 40 is capable of dispensing a water spray having an angle coverage generally corresponding to the positive angle θ. The aperture member 40 defines a periphery corresponding to the angle coverage. The aperture member 40 is formed as a slot on the circumference partition 34 of the cap 30.

In this case, the circumference wall 20, the cap 30, and the aperture member 30 are made integrally as a whole.

The first recognition portion 22 corresponds with the aperture member 40, and approximately spans over the periphery of the aperture member 40. The first recognition portion 22 defines two conjunction borders parallel with the axis Z and adjoining those of the second recognition portion 24 for aligning with two opposite endpoints of the periphery of the aperture member 40, so that a perimeter of the first recognition portion 22 indicates a spray zone. The second recognition portion 24 is visually different from the first recognition portion 22 and spans a remaining part of the circumference wall 20 and specifies a non-spray zone. The first recognition portion 22 is of predetermined art elements dissimilar from that of the second recognition portion 24 for visual identification.

In one case, the first recognition portion 22 is of a first color different and distinguishable from a second color of the second recognition portion 24, therefore a visual recognition is offered.

In another case, the first recognition portion 22 is of a first texture different and distinguishable from a second texture of the second recognition portion, and the first and second textures create subtle tone difference due to reflection of light.

In an alternative embodiment (not illustrated), the cap is a flat surface, and the aperture member is disposed on the cap.

In an alternative embodiment (not illustrated), the cap is an insert assembled onto the housing, and the aperture member is disposed on the cap.

Second Embodiment

Figure 4:
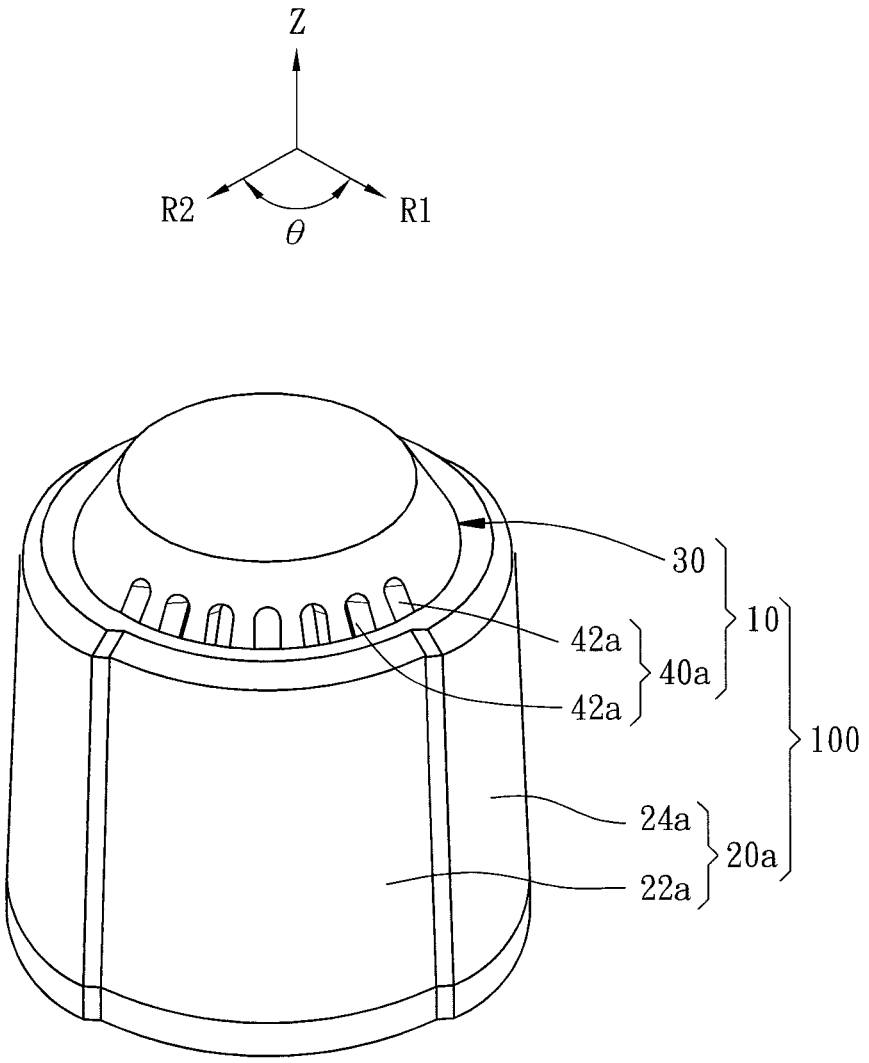
FIG. 4 is a perspective view illustrating the sprinkler head of visual identification in accordance to a second embodiment of the present invention.
Figure 5:
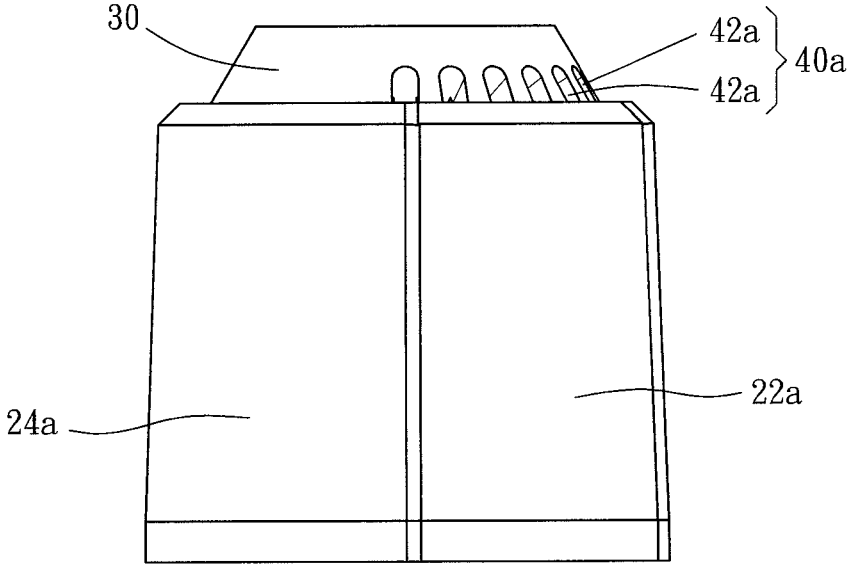
FIG. 5 is a lateral view in accordance to FIG. 4.
Figure 6:
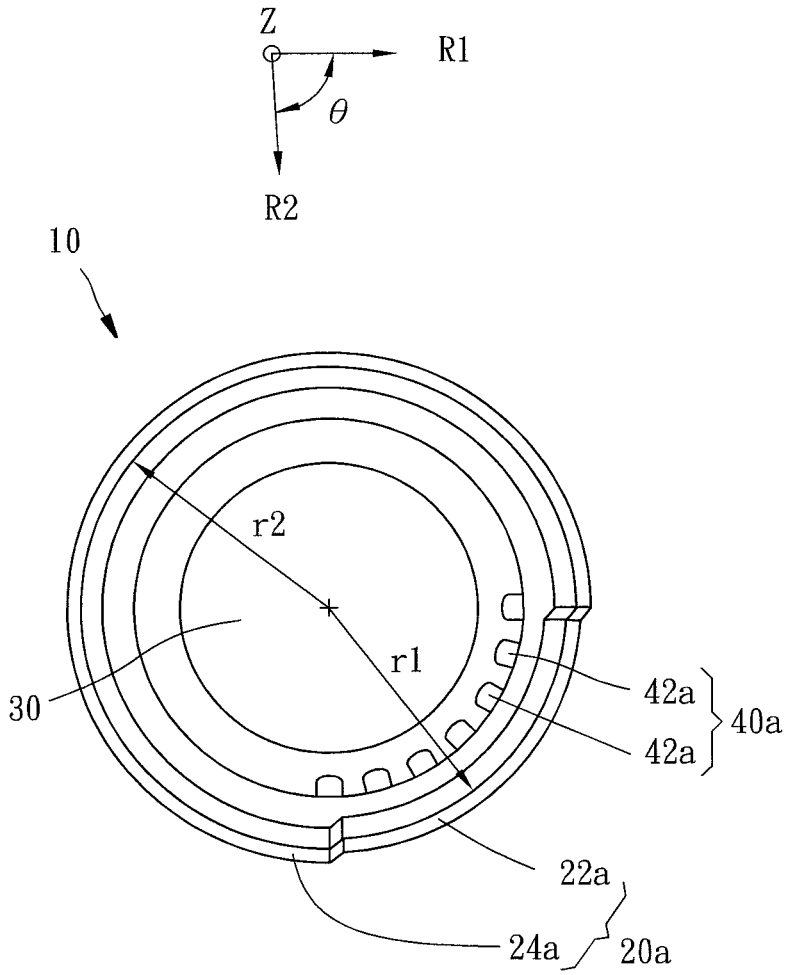
FIG. 6 is a top plan view in accordance to FIG. 4.

FIGS. 4 through 6 pertain to a second embodiment of the invention. In this case, an aperture member 40*a* is formed by a plurality of holes 42*a* set along the periphery and formed on the circumference partition 34 of the cap 30. The housing 10 defines a first radius r1 and a second radius r2 orientated from the axis Z, and the second radius r2 is greater than the first radius rt. A first recognition portion 22*a* is of the first radius r1, while a second recognition portion 24*a* is of the second radius r2. Therefore, a visual recognition by various radiuses is offered.

Third Embodiment

Figure 7:
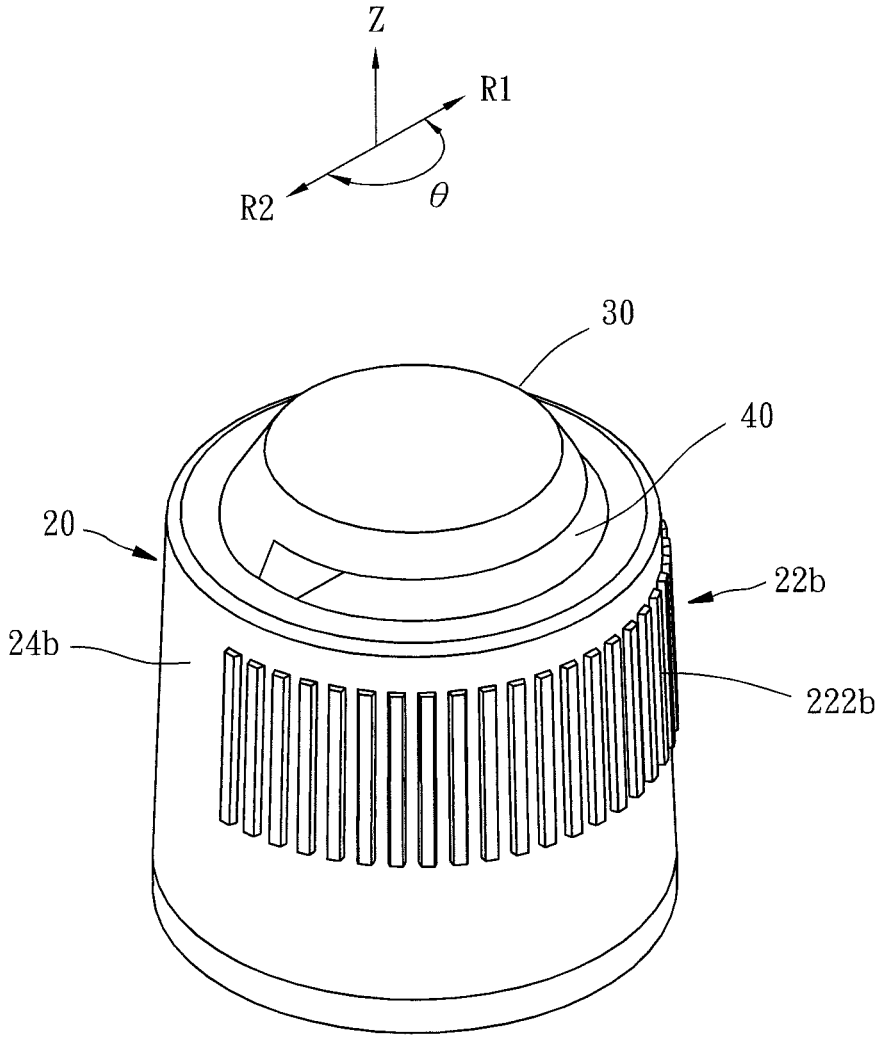
FIG. 7 is a perspective view illustrating the sprinkler head of visual identification in accordance to a third embodiment of the present invention.
Figure 8:
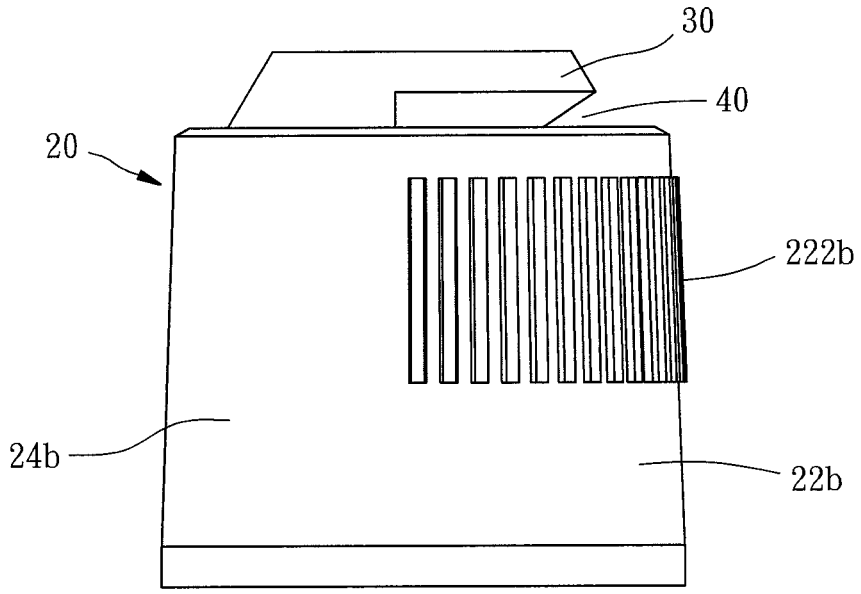
FIG. 8 is a lateral view in accordance to FIG. 7.
Figure 9:
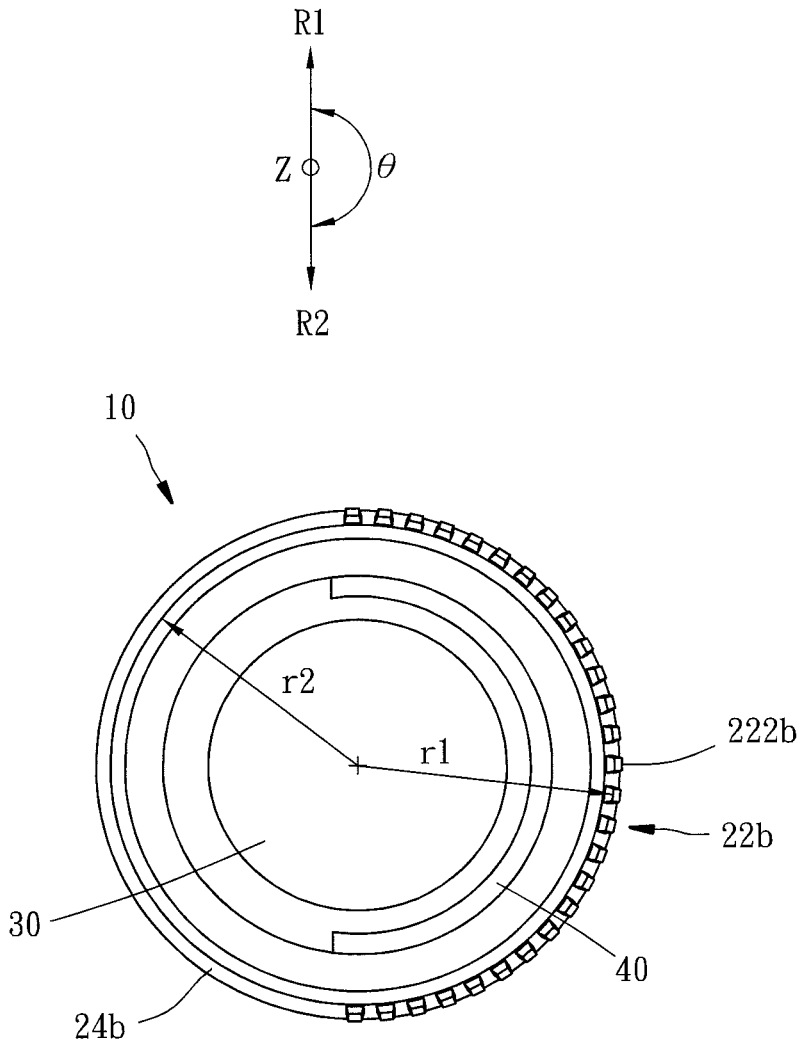
FIG. 9 is a top plan view in accordance to FIG. 7.

FIGS. 7 through 9 pertain to a third embodiment of the invention. A first recognition portion 22*b* includes a plurality of striped projections 222*b*, which parallel with one another, arranged thereof. A second recognition portion 24*b* is generally smooth. Therefore, a visual recognition by the texture on the first recognition portion 22*b* is offered.

In an alternative embodiment (not illustrated), a pair of striped ridges are respectively disposed on two circumferential ends of the first recognition portion 22*b*, and the striped ridges are more pronounced than the striped projections.

In an alternative embodiment (not illustrated), the first recognition portion is a printed mark composed of a plurality of bands.

In an alternative embodiment (not illustrated), the first recognition portion includes the striped projections 222*b* partially and spirally winding around the axis Z of the housing.

In an alternative embodiment (not illustrated), the first recognition portion includes the striped projections 222*b* being arranged as first teeth spaced apart by a first pitch.

Fourth Embodiment

Figure 10:
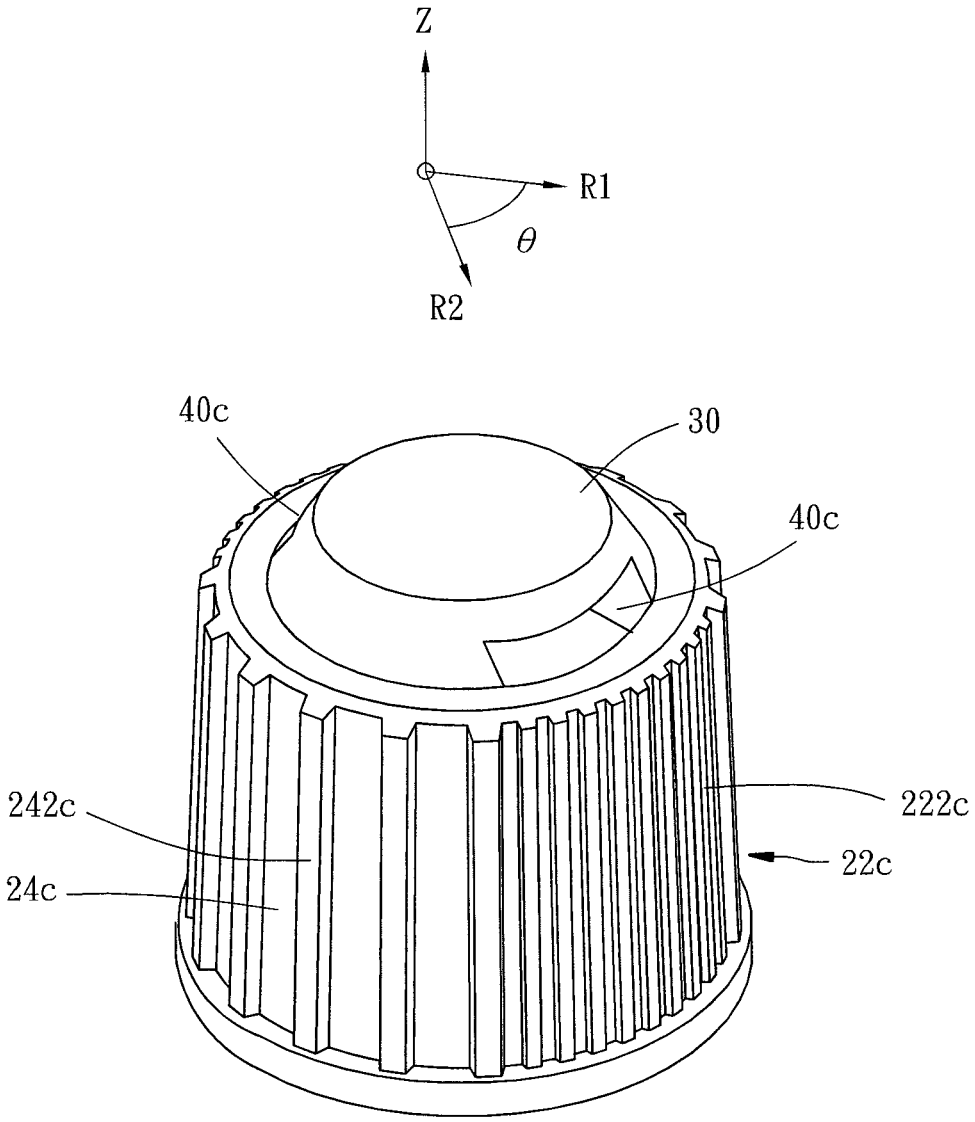
FIG. 10 is a perspective view illustrating the sprinkler head of visual identification in accordance to a fourth embodiment of the present invention.
Figure 11:
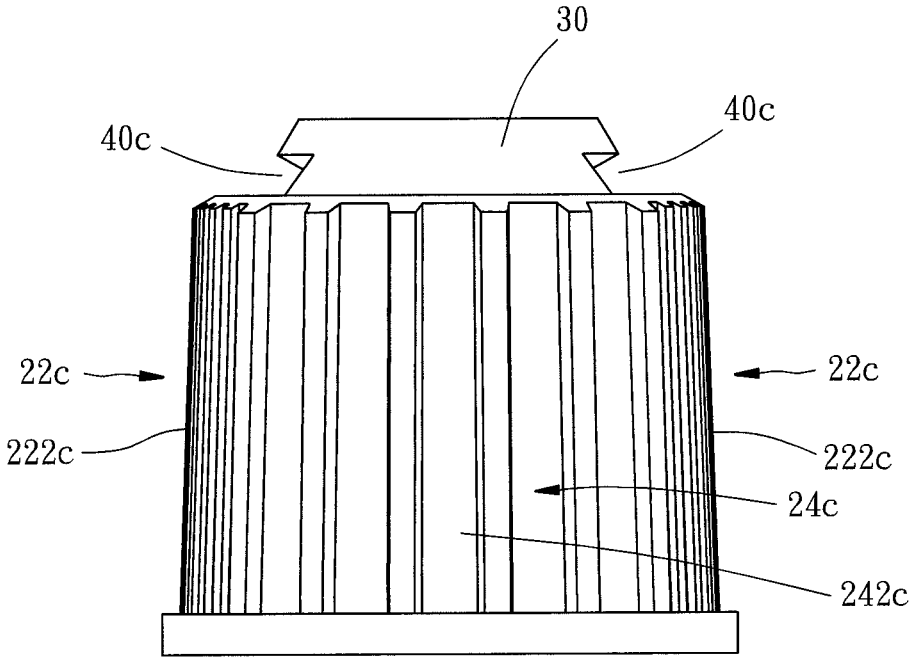
FIG. 11 is a lateral view in accordance to FIG. 10.
Figure 12:
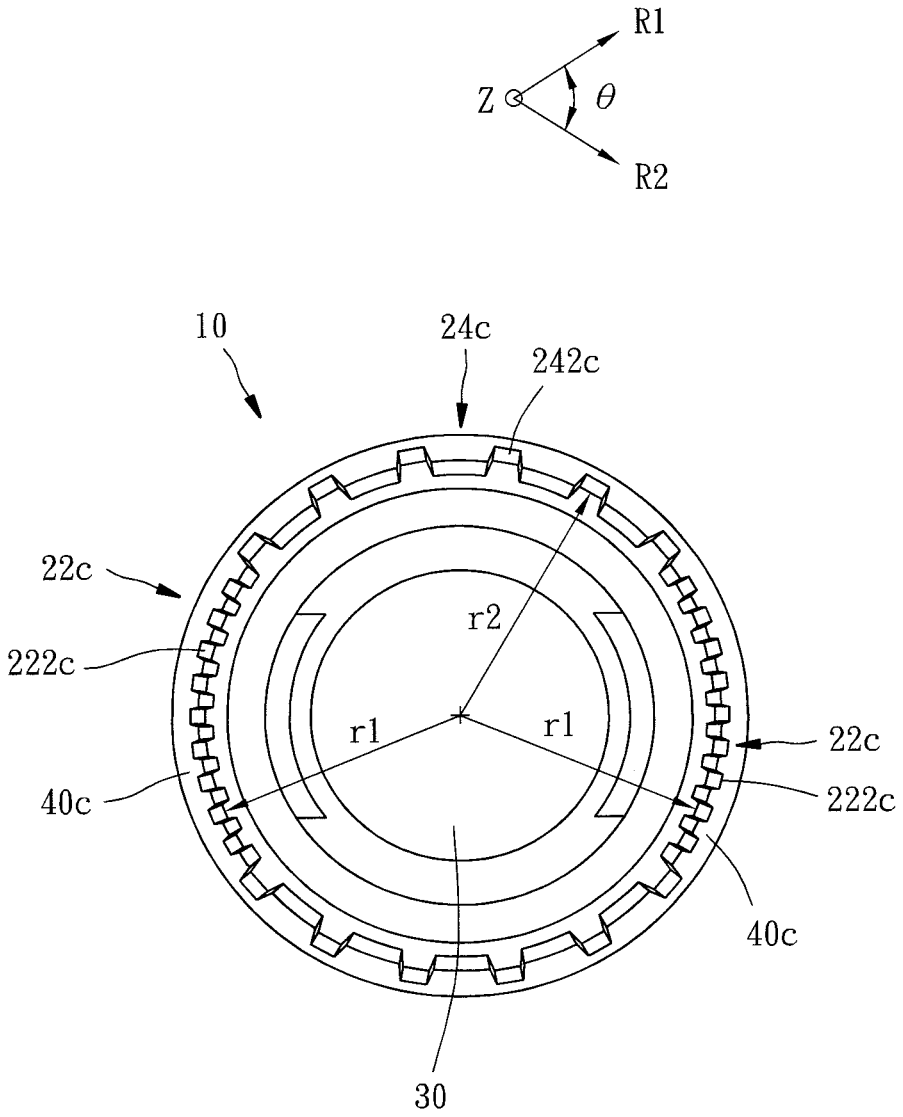
FIG. 12 is a top plan view in accordance to FIG. 10.

FIGS. 10 through 12 pertain to a fourth embodiment, derivative from the third embodiment, according to the invention. Two aperture members 40*c* are disposed on the cap 30 and spaced from each other. Each aperture member 40*c*, in this case, is formed of a slot with a periphery. Two first recognition portions 22*c* corresponds with the aperture members 40*c* respectively, and two second recognition portions 24*c* are staggered with the first recognition portions 22*c*. Each of the first recognition portions 22*c* includes a plurality of first teeth 222*c* spaced apart by a first pitch, while each of the second recognition portions 24*c* includes a plurality of second teeth 242*c* spaced apart by a second pitch. The first and second pitches are different from each other. The first pitch of the first teeth 222*c* is less than the second pitch of the second teeth 242*c*. The housing 10 defines a first radius r1 and a second radius r2 orientated from the axis Z. The second radius r2 is greater than the first radius r1, and each of the first recognition portions 22*d* is of the first radius r1, while each the second recognition portions 24*d* is of the second radius r2. By the various radiuses and pitches, a visual differentiation of the first recognition portion and the second one is offered.

In an alternative embodiment (not illustrated), the first and second pitches are generally equal, and the tooth width of the first teeth 222*c* is smaller than the tooth width of the second teeth 242*c*. By the various radiuses and tooth widths, a visual differentiation of the first recognition portion and the second one is offered.

In an alternative embodiment (not illustrated), the first radius r1 and the second radius r2 are equal, the tooth width of the first teeth 222*c* is smaller than the tooth width of the second teeth 242*c*. By the various pitches and tooth widths, a visual differentiation of the first recognition portion and the second one is offered.

Fifth Embodiment

Figure 13:
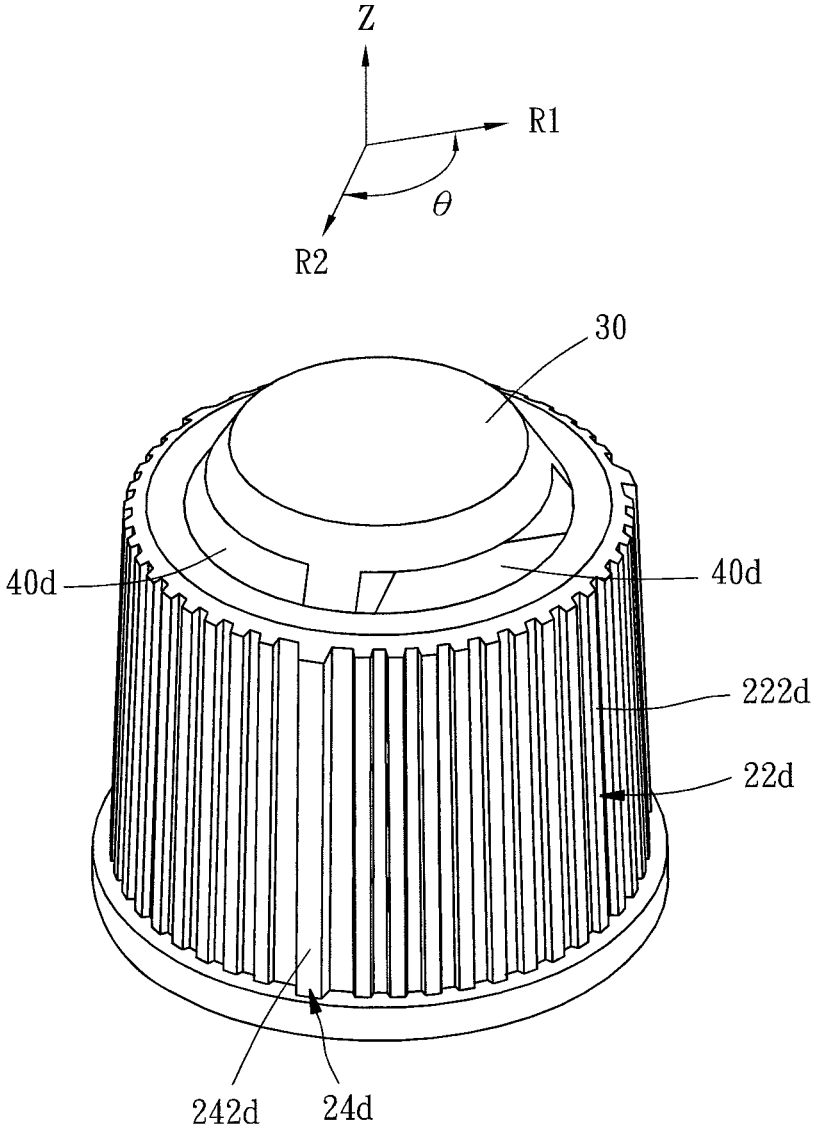
FIG. 13 is a perspective view illustrating the sprinkler head of visual identification in accordance to a fifth embodiment of the present invention.
Figure 14:
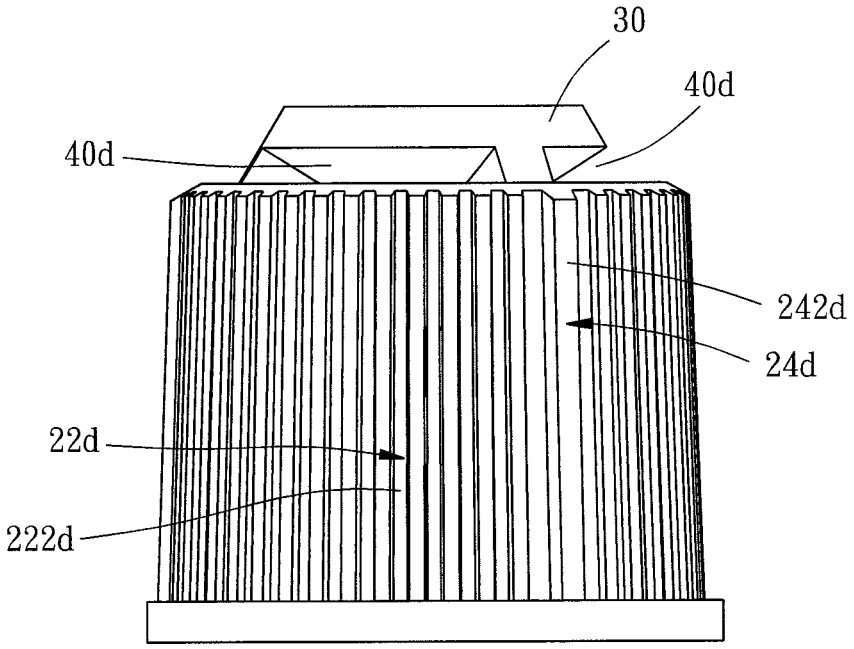
FIG. 14 is a lateral view in accordance to FIG. 13.
Figure 15:
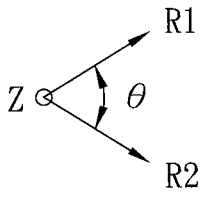
FIG. 15 is a top plan view in accordance to FIG. 13.
Figure 15:
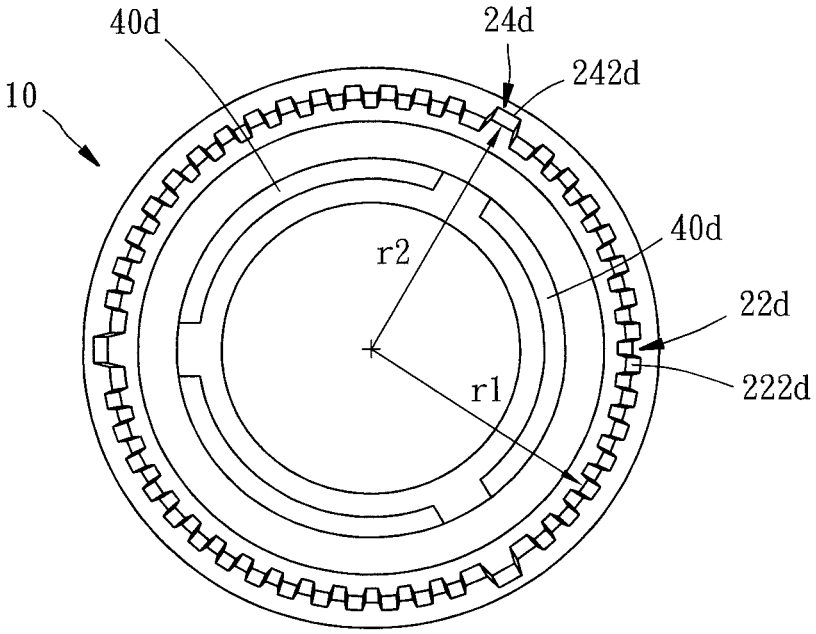
Figure 16:
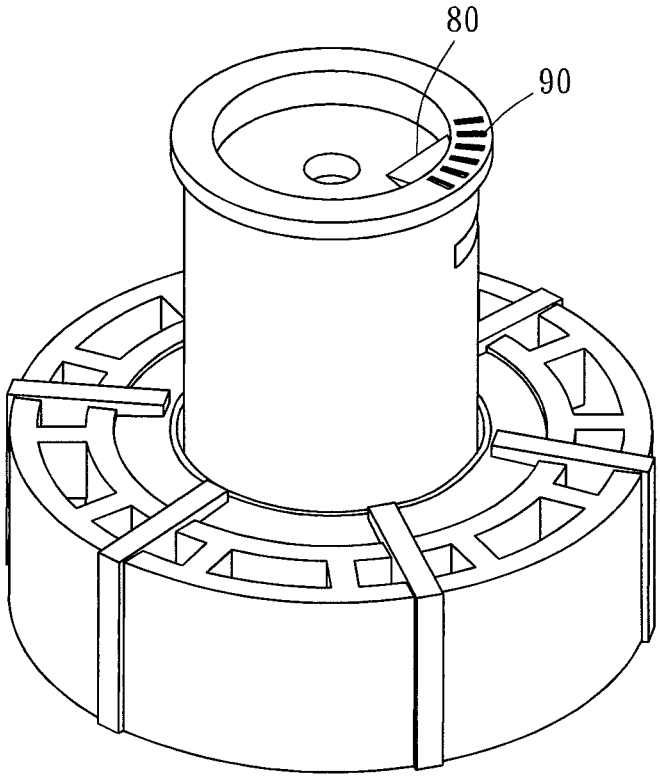
FIG. 16 PRIOR ART
FIG. 16 is perspective view illustrating a conventional in-ground pop-up sprinkler.

FIGS. 13 through 15 pertain to a fifth embodiment of the invention. A plurality of aperture members 40*d*, three aperture members 40*d* in this case, are formed on the cap 30 and spaced from one another. Each of the aperture members 40*d* defines a periphery. A plurality of first recognition portions 22*d* corresponds with the aperture members 40*d* respectively, and a plurality of second recognition portions 24*d* are staggered with the first recognition portions 22*d*. Each of the first recognition portions 22*d* includes a plurality of first teeth 222*d* spaced apart by a first pitch, while each of the second recognition portions 24*d* includes a second tooth 242*d*. The housing 10 defines a first radius r1 and a second radius r2 orientated from the axis Z. The second radius r2 is greater than the first radius r1, and each of the first recognition portions 22*d* is of the first radius r1, while each of the second recognition portions 24*d* is of the second radius r2.

It should be noted that the aperture members 40*d* together offers a spray pattern that can be generally described as full-circle. Each of the first recognition portions 22*d* is visually more prominent than each of the second recognition portions 24*d*, and therefore the first recognition portions 22*d* may be interpreted as indicating a full-circle spray pattern.

It should be apparent that, regardless of the number of aperture members defined, a visual recognition differentiating the first recognition portion from the second one can be achieved in accordance with the arrangement of dissimilar art elements, such as texture, radiuses and teeth.

It should be appreciated that dissimilarity needs not be pronounced. With proper combination, a combination of subtly different art elements can achieve distinguishable differences.

Therefore, under at least one or a combination of visually dissimilar art elements on different recognition portions, the sprinkler head 100 of visual identification in the present invention is capable of specifying a spray zone by the first recognition portion of the circumference wall of the housing. The distinguishing art elements on the first and the second recognition portions may be consistently applied to various sprinkler heads, so that an irrigation system comprising such sprinkler heads can be easily installed and maintained.

The preceding description is meant to be illustrative of preferred embodiments and should not be construed as limiting the scope of the present invention. Various modifications, which would be readily apparent to one skilled in the art, are intended to be within the scope of the present invention. Accordingly, the only limitations to the scope of the present invention are set forth in the following claims appended hereto.

What is claimed is:

1. A sprinkler head of visual identification comprising: a housing defining an axis; the housing having a circumference wall surrounding around the axis, a cap in direct contact with and enclosing a top of the circumference wall, and at least one aperture member formed on the cap for dispensing water; wherein the at least one aperture member defines a periphery which corresponds to a coverage angle; wherein the circumference wall, the cap, and the at least one aperture member are non-movable relative to each other; and at least one first recognition portion and at least one second recognition portion disposed on the circumference wall and adjoining with one another end to end; wherein the at least one first recognition portion corresponds with and spans over the periphery of the at least one aperture member, and the periphery of the aperture member is not extended to the at least one second recognition portion; and the at least one second recognition portion is visually different from the at least one first recognition portion, wherein the coverage angle corresponds to a direction for dispensing water, wherein the at least one first recognition portion includes a plurality of first teeth spaced apart by a first pitch, while the at least one second recognition portion includes at least one second tooth.

2. The sprinkler head of visual identification as claimed in claim 1, wherein the at least one second tooth of the at least one second recognition portion includes a plurality of second teeth spaced apart by a second pitch.

3. The sprinkler head of visual identification as claimed in claim 2, wherein the second pitch of the plurality of second teeth is different from the first pitch of the plurality of first teeth.

4. The sprinkler head of visual identification as claimed in claim 1, wherein the housing defines a first radius and a second radius orientated from the axis; the second radius is different from the first radius; the at least one first recognition portion is of the first radius, while the at least one second recognition portion is of the second radius.

5. The sprinkler head of visual identification as claimed in claim 1, wherein the at least one aperture member includes a plurality of aperture members formed on the cap and spaced from each other, each of the plurality of aperture members defines a periphery; a plurality of first recognition portions of the at least one first recognition portion are arranged on the circumference wall of the housing and spanned over the plurality of aperture members respectively, and a plurality of second recognition portions of the at least one first recognition portion are arranged on the circumference wall of the housing, and each of the plurality of first recognition portions is spaced with each of the plurality of second recognition portions.

6. The sprinkler head of visual identification as claimed in claim 5, wherein the housing defines a first radius and a second radius orientated from the axis; the second radius is different from the first radius; each of the plurality of first recognition portions is of the first radius, while each of the plurality of second recognition portions is of the second radius.

7. The sprinkler head of visual identification as claimed in claim 5, wherein each of the plurality of first recognition portions includes a plurality of first teeth spaced apart by a first pitch, while each of the plurality of second recognition portions includes a plurality of second teeth spaced apart by a second pitch; the first pitch of the plurality of first teeth is different from the second pitch of the plurality of second teeth.

8. The sprinkler head of visual identification as claimed in claim 5, wherein each of the plurality of first recognition portions includes a plurality of first teeth spaced apart by a first pitch.

9. The sprinkler head of visual identification as claimed in claim 8, wherein each of the plurality of second recognition portions includes one second tooth.

10. The sprinkler head of visual identification as claimed in claim 1, wherein the circumference wall, the cap, and the aperture member are made integrally as a whole.

11. The sprinkler head of visual identification as claimed in claim 3, wherein the circumference wall, the cap, and the aperture member are made integrally as a whole.

12. The sprinkler head of visual identification as claimed in claim 4, wherein the circumference wall, the cap, and the aperture member are made integrally as a whole.

* * * * *